US006672090B1

(12) United States Patent
Healy et al.

(10) Patent No.: US 6,672,090 B1
(45) Date of Patent: Jan. 6, 2004

(54) REFRIGERATION CONTROL

(75) Inventors: John Joseph Healy, Discovery Bay (HK); Man Wai Wu, Hong Kong (HK); Mark Lai Yuen Ng, Kowloon (HK); Hung M. Pham, Dayton, OH (US)

(73) Assignee: Copeland Corporation, Sidney, OH (US)

( * ) Notice: Subject to any disclaimer, the term of this patent is extended or adjusted under 35 U.S.C. 154(b) by 0 days.

(21) Appl. No.: 10/195,839

(22) Filed: Jul. 15, 2002

(51) Int. Cl.[7] ..... F25B 41/00; F25B 1/00

(52) U.S. Cl. ..... 62/203; 62/228.3

(58) Field of Search ..... 62/203, 217, 228.3, 62/229, 226, 228.5; 417/39

(56) References Cited

U.S. PATENT DOCUMENTS 6,047,557 A * 4/2000 Pham et al. ..... 62/228.5
6,213,731 B1 * 4/2001 Doepker et al. ..... 417/310
6,499,305 B2 * 12/2002 Pham et al. ..... 62/126

* cited by examiner

*Primary Examiner*—Marc Norman
(74) *Attorney, Agent, or Firm*—Harness, Dickey & Pierce, P.L.C.

(57) ABSTRACT

A system including an evaporator, a variable capacity compressor coupled in fluid communication with the evaporator, a condenser coupled in fluid communication between the compressor and the evaporator, an expansion valve disposed intermediate the condenser and the evaporator, and an isolation valve disposed intermediate the condenser and the expansion valve is provided. The isolation valve is in communication with the compressor to respectively synchronize opening and closing thereof with on- and off-cycles of the compressor to prohibit migration of liquid refrigerant. In an alternative embodiment, first and second check valves are respectively associated with the compressor and the condensor for prohibiting reverse migration of refrigerant during off-cycle.

15 Claims, 6 Drawing Sheets

REFRIGERATION CONTROL

FIELD OF THE INVENTION

The present invention relates to refrigeration systems, compressor control systems and refrigerant regulating valve control systems. More particularly, the invention relates to liquid-side and vapor-side flow control strategies.

BACKGROUND OF THE INVENTION

Traditional refrigeration systems include a compressor, a condenser, an expansion valve, and an evaporator, all interconnected for establishing series fluid communication therebetween. Cooling is accomplished through evaporation of a liquid refrigerant under reduced temperature and pressure. Initially, vapor refrigerant is drawn into the compressor for compression therein. Compression of the vapor refrigerant results in a higher temperature and pressure thereof. From the compressor, the vapor refrigerant flows into the condenser. The condenser acts as a heat exchanger and is in heat exchange relationship with ambient. Heat is transferred from the vapor refrigerant to ambient, whereby the temperature is lowered. In this manner, a state change occurs, whereby the vapor refrigerant condenses to a liquid.

The liquid refrigerant exits an outlet of the condenser and flows into the expansion valve. As the liquid refrigerant flows through the expansion valve, its pressure is reduced prior to entering the evaporator. The evaporator acts as a heat exchanger, similar to the condenser, and is in heat exchange relationship with a cooled area (e.g., an interior of a refrigeration case). Heat is transferred from the cooled area to the liquid refrigerant, thereby increasing the temperature of the liquid refrigerant and resulting in boiling thereof. In this manner, a state change occurs, whereby the liquid refrigerant becomes a vapor. The vapor refrigerant then flows from the evaporators, back to the compressor.

The cooling capacity of the refrigeration system is generally achieved by varying the capacity of the compressor. One method of achieving capacity variation is continuously switching the compressor between on- and off-cycles using a pulse-width modulated signal. In this manner, a desired percent duty cycle for the compressor can be achieved. During the off-cycles, liquid refrigerant experiences "free-wheel" flow, whereby the liquid refrigerant migrates into the evaporator. As the refrigerant migrates into the evaporator during the off-cycle, it is boiled therein, and becomes a vapor. This is detrimental to the performance of the refrigeration system in two ways: a significant reduction in the on-cycle evaporator temperature, and a decrease in flow recovery once switched back to the on-cycle.

Further, significant losses occur with traditional refrigeration systems when recently compressed vapor reverse migrates through the compressor, back toward the evaporator, during the off-cycle. These losses are compounded by reverse migration of liquid refrigerant back into the condenser during the off-cycle.

Therefore, it is desirable in the industry to provide a refrigeration system and flow control strategy for alleviating the deficiencies associated with traditional refrigeration systems. In particular, the refrigeration system should prohibit migration of liquid refrigerant into the evaporator during the off-cycle, prohibit reverse migration of vapor refrigerant through the compressor during the off-cycle, and prohibit reverse migration of liquid refrigerant through the condenser during the off-cycle.

SUMMARY OF THE INVENTION

Accordingly, the present invention provides a refrigeration system and control method thereof, for alleviating the deficiencies associated with traditional refrigeration systems. More particularly, the refrigeration system includes an evaporator, a variable capacity compressor coupled in fluid communication with the evaporator, a condenser coupled in fluid communication between the compressor and the evaporator, an expansion valve disposed intermediate the condenser and the evaporator, and an isolation valve disposed intermediate the condenser and the expansion valve. The isolation valve is in communication with the compressor for respectively synchronizing opening and closing thereof with on- and off-cycles of the compressor to prohibit migration of liquid refrigerant. In this manner, respective temperatures of the condenser and evaporator are better maintained during the off-cycle.

In accordance with an alternative embodiment, first and second check valves are respectively associated with the compressor and the condenser for prohibiting reverse migration of refrigerant during the off-cycle. In this manner, respective pressures of the refrigerant associated with the condenser and evaporator are decreased over a traditional refrigeration system.

The present invention further provides a method for controlling a refrigeration system having a compressor, a condenser and an evaporator connected in series flow communication. The method includes the steps of varying the compressor between on- and off-cycles to provide a percent duty cycle thereof, and synchronizing opening and closing of an isolation valve, respectively with the on- and off-cycles of the compressor, to prohibit migration of liquid refrigerant into the evaporator during the off-cycle.

In accordance with an alternative embodiment, the method further includes the steps of prohibiting reverse migration of the liquid refrigerant into the condenser, and prohibiting reverse migration of vapor refrigerant through the compressor, during the off-cycle.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
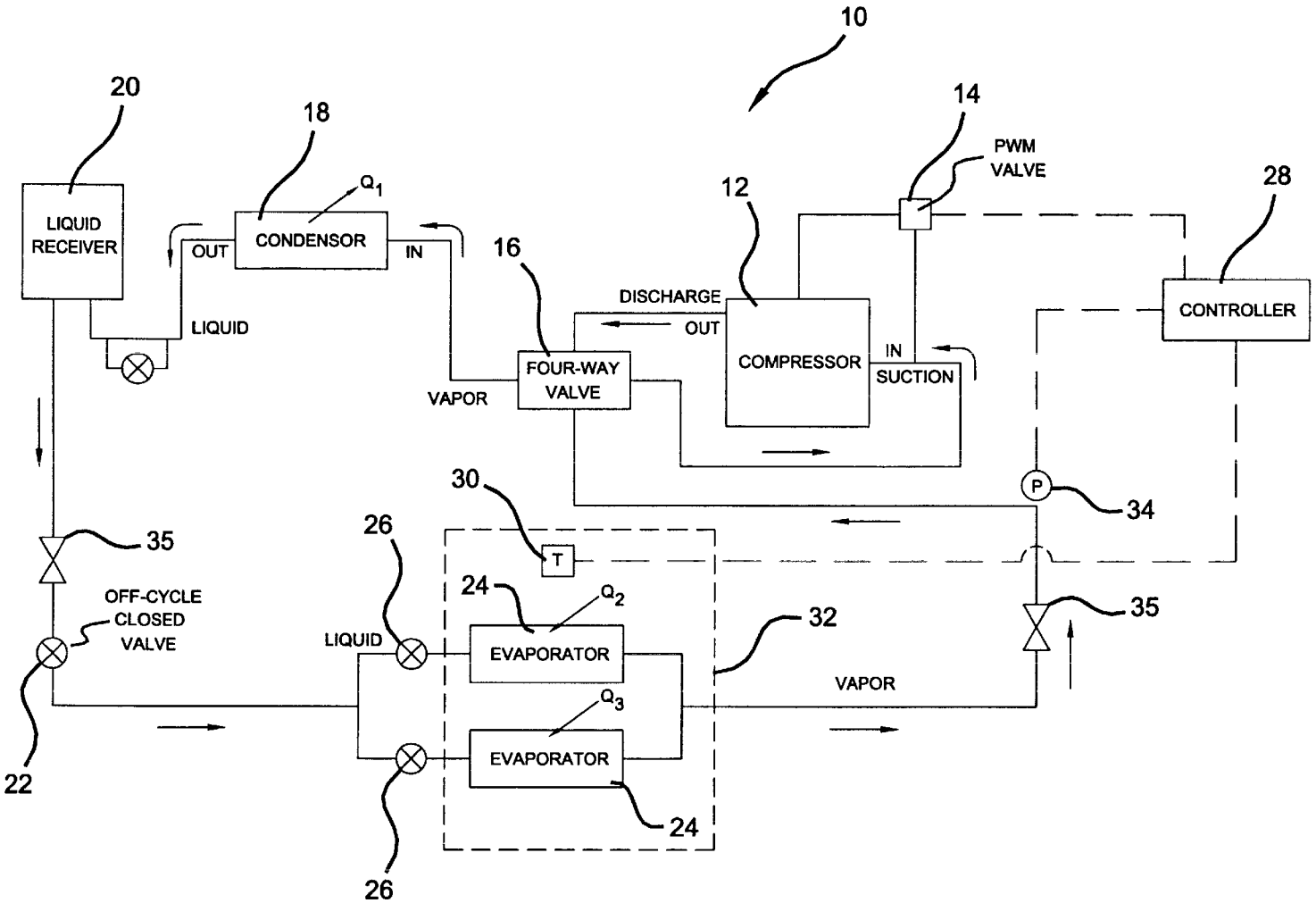
FIG. 1 is a schematic view of a refrigeration system implementing a closed expansion valve in accordance with the principles of the present invention.

With particular reference to FIG. 1, a refrigeration system 10 is schematically shown. Although the refrigeration system 10 is representative of a heat pump system, it will be appreciated that the implementation thereof, in accordance with the present invention, is for refrigeration. The refrigeration system 10 includes a compressor 12 having an associated pulse-width modulation (PWM) valve 14, a four-way valve 16, a condenser 18, a liquid receiver 20, an isolation valve 22, dual evaporators 24 having respective expansion valves 26, and a controller 28. The controller 28 is in operable communication with the PWM valve 14 of the compressor 12, a temperature sensor sensing 30 a temperature of a refrigerated area 32 (e.g. interior of a refrigeration case), and a pressure sensor 34 sensing a pressure of a refrigerant vapor discharged from the dual evaporators 24, as explained in further detail hereinbelow. Although the present description includes dual evaporators, it is anticipated that the number of evaporators may vary, depending on particular system design requirements. Multiple maintenance valves 35 are also provided to enable maintenance and removal/addition of the various components.

The compressor 12, and operation thereof, is similar to that disclosed in commonly assigned U.S. Pat. No. 6,047,557, entitled ADAPTIVE CONTROL FOR A REFRIGERATION SYSTEM USING PULSE WIDTH MODULATED DUTY CYCLE SCROLL COMPRESSOR, expressly incorporated herein by reference. A summary of the construction and operation of the compressor 12 is provided herein.

The compressor includes an outer shell and a pair of scroll members supported therein and drivingly connected to a motor-driven crankshaft. One scroll member orbits respective to the other, whereby suction gas is drawn into the shell via a suction inlet. Intermeshing wraps provided on the scroll members define moving fluid pockets that progressively decrease in size and move radially inwardly as a result of the orbiting motion of the scroll member. In this manner, the suction gas entering via the inlet is compressed. The compressed gas is then discharged into a discharge chamber.

In order to switch to an off-cycle (i.e., unload the PWM compressor 12), the PWM valve 14 is actuated in response to a signal from the controller 28, thereby interrupting fluid communication to increase a pressure within the inlet to that of the discharge gas. The biasing force resulting from this discharge pressure causes the non-orbiting scroll member to move axially upwardly away from the orbiting scroll member. This axial movement will result in the creation of a leakage path between the scroll members, thereby substantially eliminating continued compression of the suction gas. When switching to an on-cycle (i.e., resuming compression of the suction gas), the PWM valve 14 is actuated so as to move the non-orbiting scroll member into sealing engagement with the orbiting scroll member. In this manner, the duty cycle of the compressor 12 can be varied between zero (0) and one hundred (100) percent via the PWM valve 14, as directed by the controller 23.

The controller 28 monitors the temperature of the refrigerated area 32 and pressure of the vapor refrigerant leaving the evaporators 24. Based upon these two inputs, and implementing programmed algorithms, the controller 28 determines the percent duty cycle for the PWM compressor 12 and signals the PWM valve 14 for switching between the on- and off-cycles to achieve the desired percent duty cycle.

Operation of the refrigeration system 10 will now be described in detail. Cooling is accomplished through evaporation of a liquid refrigerant under reduced temperature and pressure. Initially, vapor refrigerant is drawn into the compressor 12 for compression therein. Compression of the vapor refrigerant results in a higher temperature and pressure thereof. From the compressor 12, the vapor refrigerant flows into the condenser 18. The condenser 18 acts as a heat exchanger and is in heat exchange relationship with ambient. Heat is transferred from the vapor refrigerant to ambient, whereby the temperature is lowered. In this manner, a state change occurs, whereby the vapor refrigerant condenses to a liquid.

The liquid refrigerant exits an outlet of the condenser 18 and is received into the receiver 20, acting as a liquid refrigerant reservoir. As explained above, the isolation valve 22 is in communication with the controller 28, whereby it switches between open and closed positions, respectively with the on-, and off-cycles of the PWM compressor 12. With the isolation valve 22 in the open position, liquid refrigerant flows therethrough and is split, flowing into each of the expansion valves 26. As the liquid refrigerant flows through the expansion valves 26, its pressure is reduced prior to entering the evaporators 24.

The evaporators 24 act as heat exchangers, similar to the condenser 18, and are in heat exchange relationship with a refrigerated area 32. Heat is transferred from the refrigerated area 32, to the liquid refrigerant, thereby increasing the temperature of the liquid refrigerant resulting in boiling thereof. In this manner, a state change occurs, whereby the liquid refrigerant becomes a vapor. The vapor refrigerant then flows from the evaporators 24, back to the compressor 12.

The off-cycle occurs when the compressor 12 is essentially turned off by the controller 28, or is otherwise operating at approximately zero (0) percent duty cycle. Pulse-width modulation results in periodic shifts between the on- and off-cycles to vary the capacity of the PWM compressor 12. As discussed by way of background, when the refrigeration system 10 switches to the off-cycle from the on-cycle, the recovery of off-cycle flow ("flywheel" flow) is significantly decreased because the refrigerant temperature within the evaporators 24 quickly rises to the surface air temperature of the evaporator exteriors. To improve the recovery of off-cycle flow, the isolation valve 22 is closed during the off-cycle. In this manner, migration of liquid refrigerant into the evaporators 24 is prevented.

Figure 2:
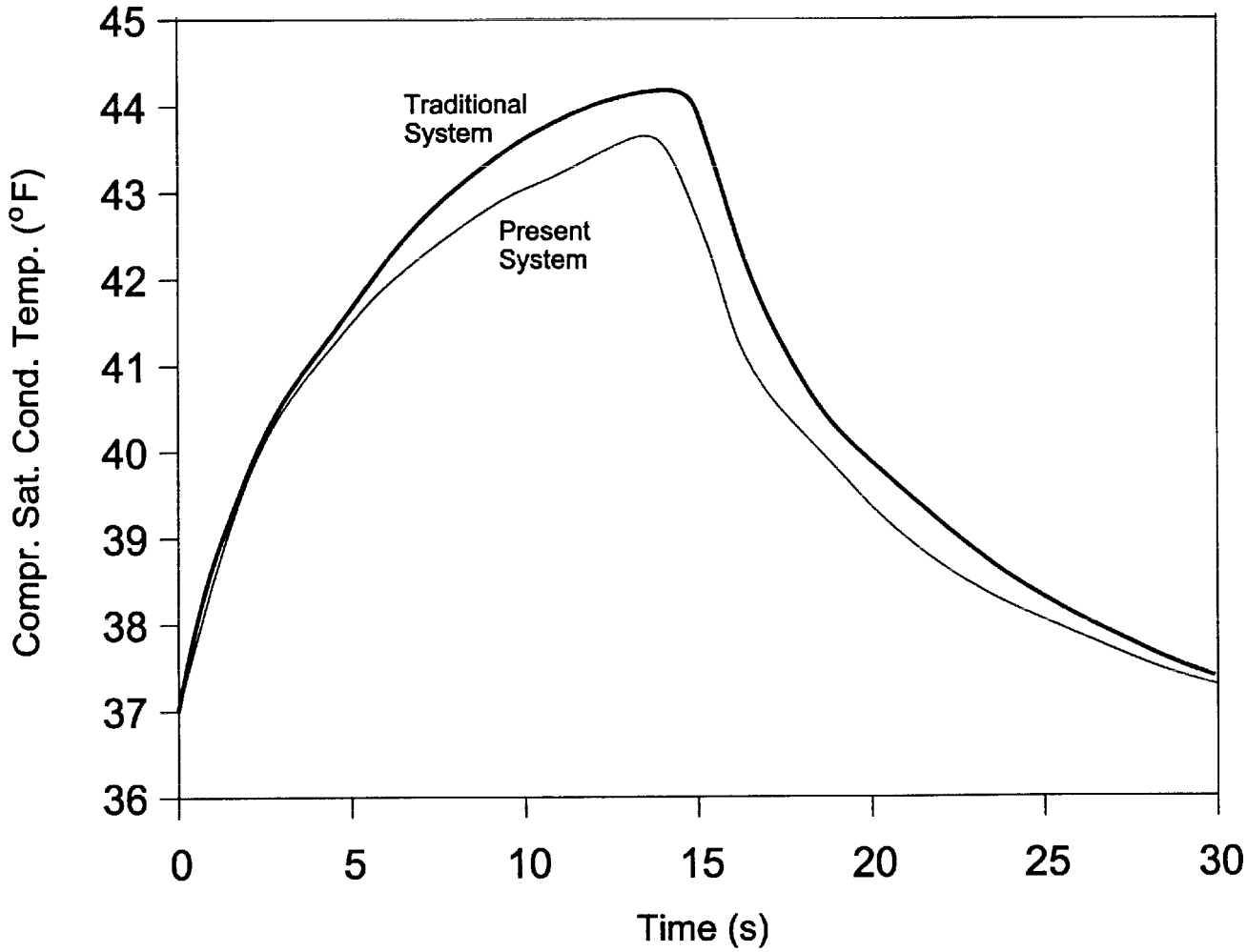
FIG. 2 is a graph comparing a condenser temperature for the refrigeration system of FIG. 1 to a condenser temperature for a traditional refrigeration system implementing a continuously open expansion valve.
Figure 3:
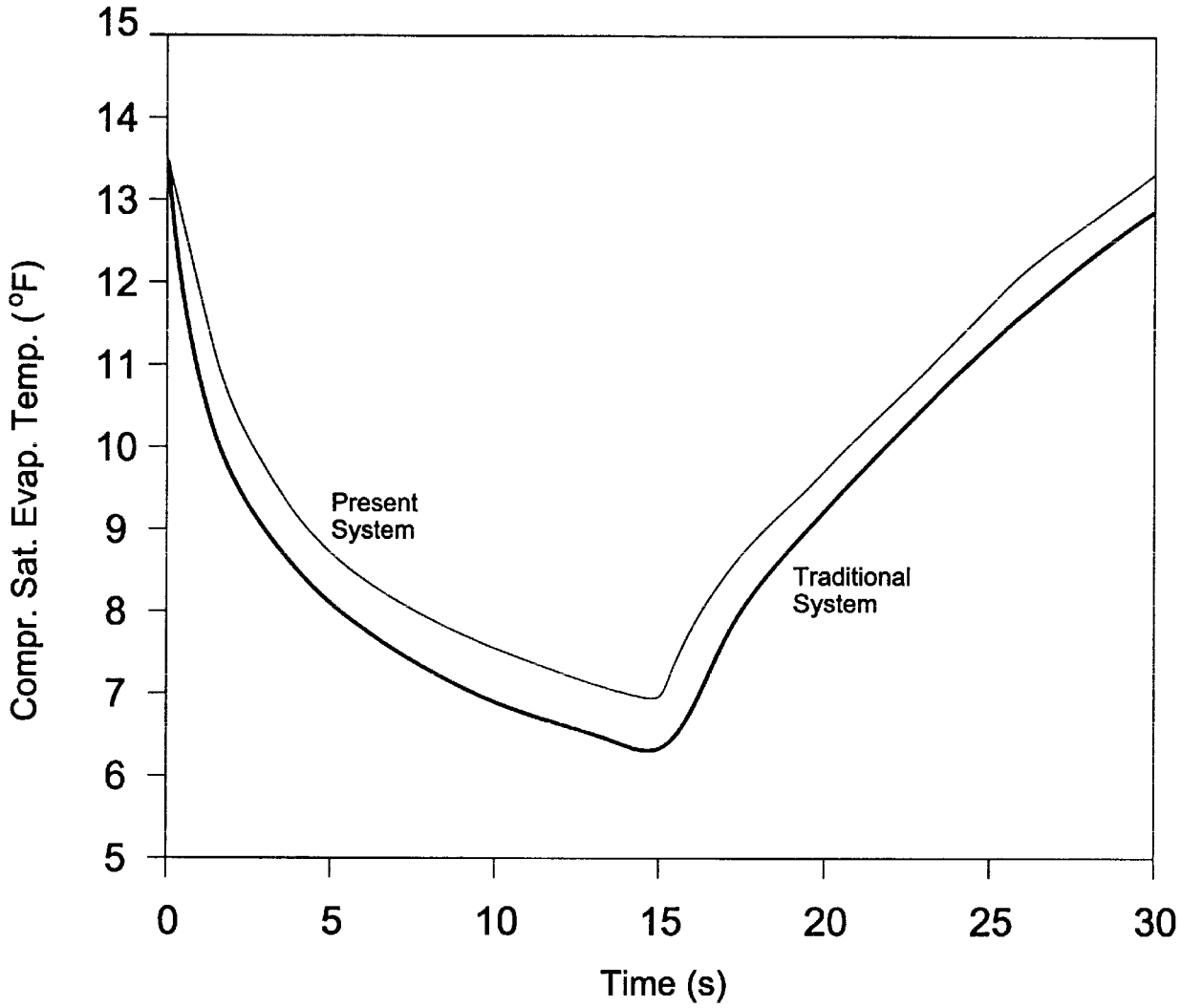
FIG. 3 is a graph comparing an evaporator temperature for the refrigeration system of FIG. 1 to a condenser temperature for a traditional refrigeration system implementing a continuously open expansion valve.

With particular reference to FIGS. 2 and 3, performance of the refrigeration system 10, implementing the isolation valve 22, can be compared to a traditional refrigeration system without such a valve, for a fifty (50) percent PWM duty cycle with a thirty (30) second cycle time. More particularly, FIG. 2 provides a comparison of the condenser temperature between the present refrigeration system 10 and a conventional refrigeration system. FIG. 3 provides a comparison of the evaporator temperature between the present refrigeration system 10 and a conventional refrigeration system. The flow recovery penalty of the conventional system can be seen, as the liquid refrigerant migration results in a lower on-cycle evaporator temperature and a correspondingly higher condenser temperature. Thus, more compressor power is required by a conventional refrigeration system to achieve an equivalent overall capacity when compared to the present refrigeration system 10. The on-cycle condensing temperature of the conventional refrigeration system is higher because the condenser must do more liquid refrigerant sub-cooling to replenish the liquid refrigerant lost during the off-cycle.

The flow recovery penalty for the conventional refrigeration system will increase with longer off-cycles or lower percent PWM duty cycles. This is due to an increased refrigerant migration effect during longer off-cycles.

Figure 4:
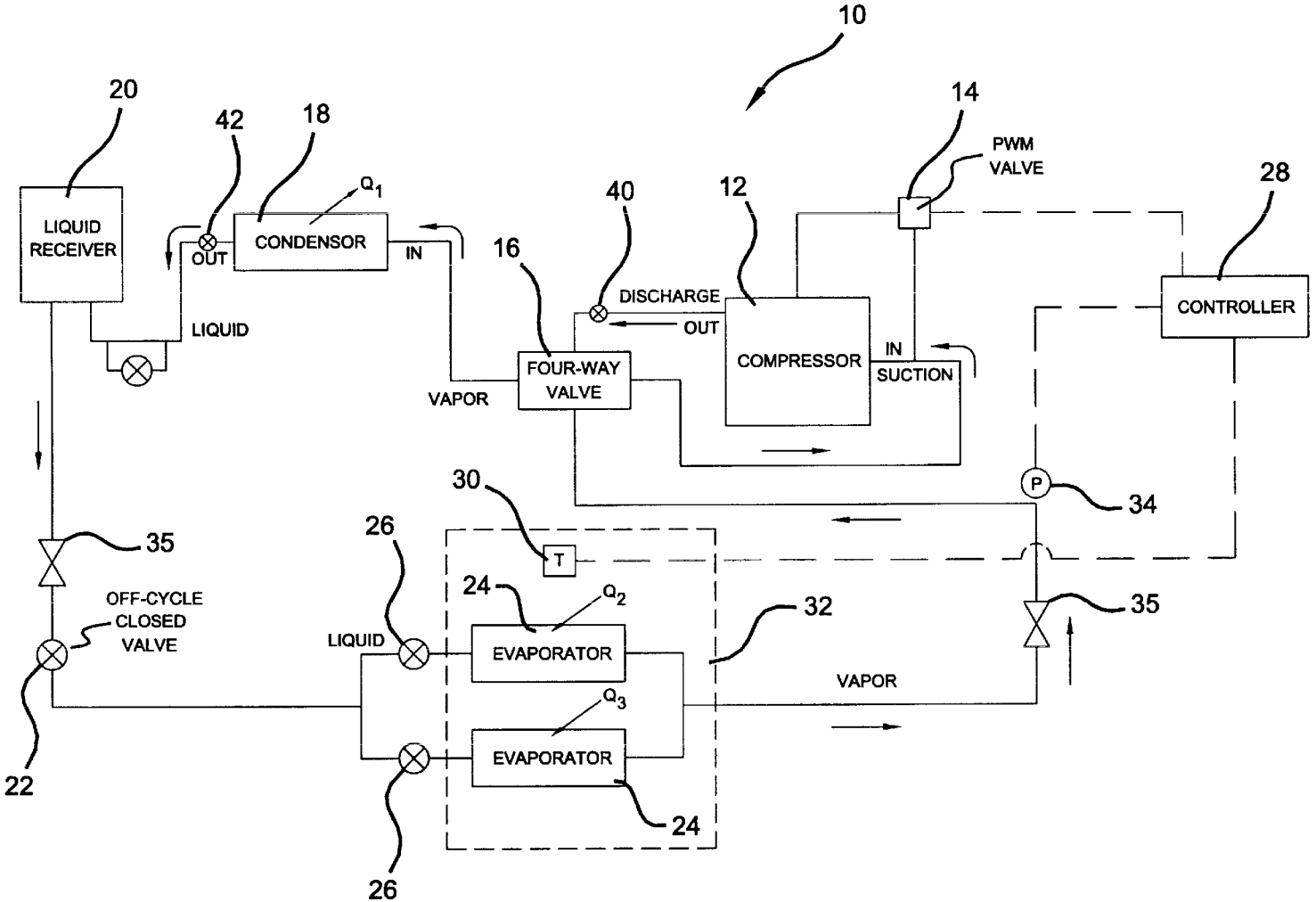
FIG. 4 is a schematic view of the refrigeration system of FIG. 1, implementing check valves in accordance with the principles of the present invention.

With particular reference to FIG. 4, the refrigeration system 10 is shown to further include first and second check valves 40, 42, respectively. The first check valve is positioned at an outlet of the PWM compressor 12, and the second check valve 42 is positioned at an outlet of the condenser 18. The refrigeration system 10, as shown in FIG. 4, operates similarly to that described above with reference to FIG. 1. However, as the refrigeration system 10 switches from the on-cycle to the off-cycle, significant gas leaking through the compressor outlet side could produce a vapor refrigerant migration effect similar to that described above for the evaporators 24. To minimize this effect, the first check valve 40 prevents vapor refrigerant migration back through the PWM compressor 12 to the evaporators 24, and the second check valve 42 assures that the liquid refrigerant in the receiver 20 stays in the receiver 20.

Figure 5:
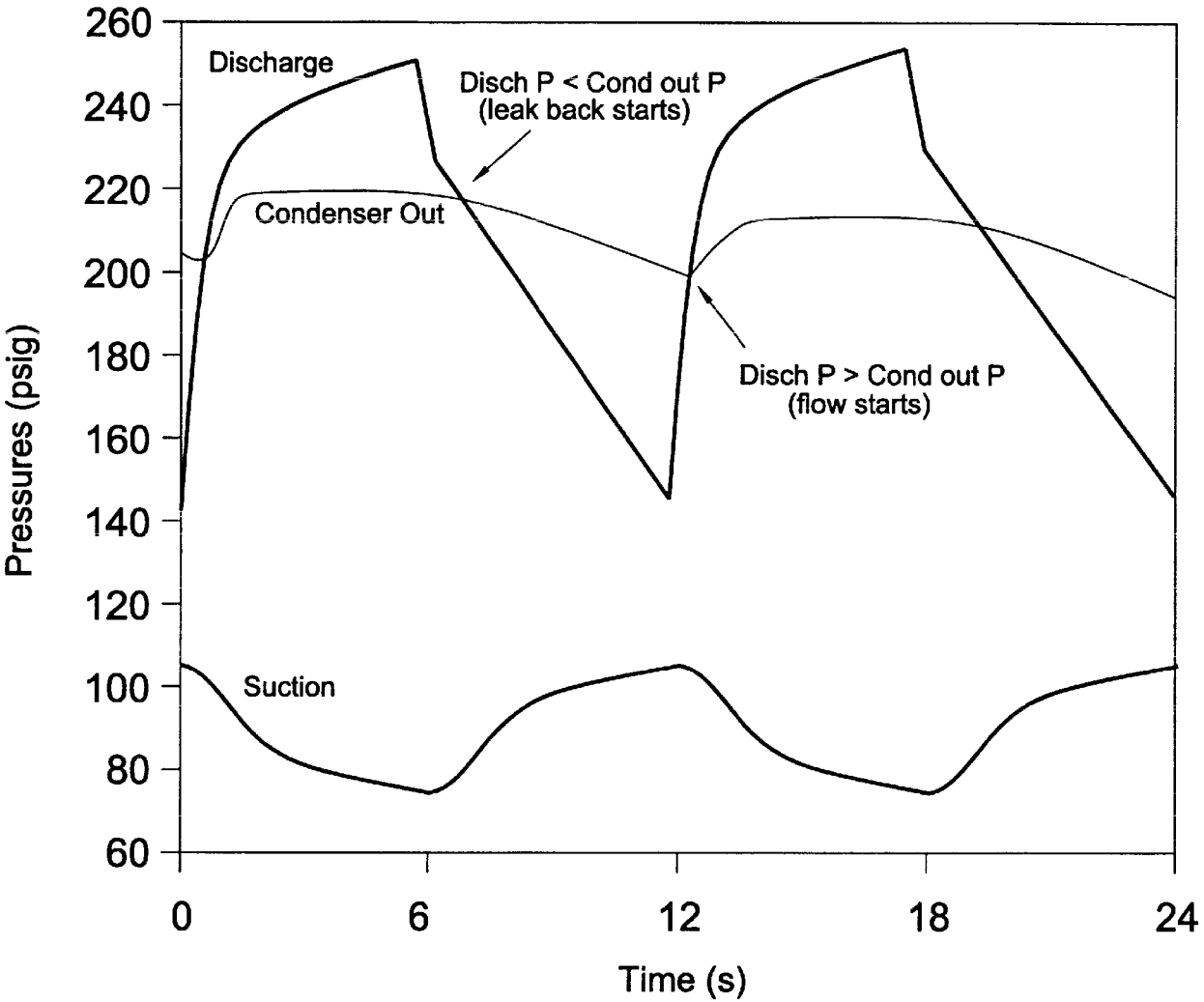
FIG. 5 is a graph depicting a pressure response for a traditional refrigeration system without the check valves.
Figure 6:
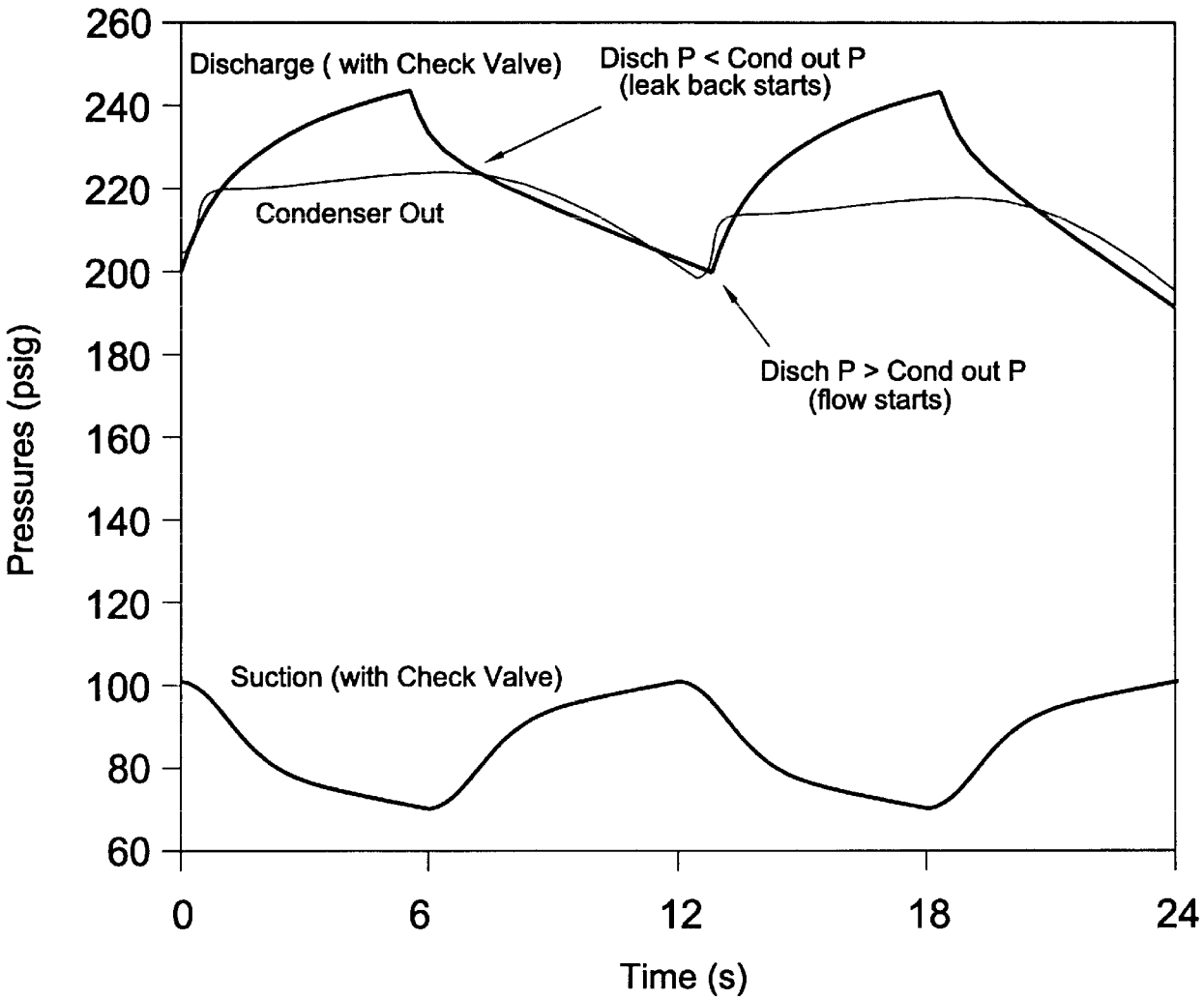
FIG. 6 is a graph depicting a pressure response for the refrigeration system of FIG. 4.

With particular reference to FIGS. 5 and 6, a performance comparison can be made between a traditional refrigeration system without check valves 40, 42 (FIG. 5), and the present refrigeration system 10 implementing the check valves 40, 42 (FIG. 6), for a fifty (50) percent PWM duty cycle with an approximately twelve (12) second cycle time. In particular, the refrigeration system pressure responses for the PWM compressor outlet (discharge), condenser outlet, and the PWM compressor inlet (suction) are shown. As can be seen, the pressure at the PWM compressor discharge is significantly increased, and a reduction in the pressure at the PWM compressor suction is also seen during the off-cycle. In this manner, the PWM compressor power penalty is significantly reduced, as compared to the traditional refrigeration system.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method of controlling a refrigeration system having a pulse-width modulated (PWM) variable capacity compressor, a condenser and an evaporator connected in series flow communication, comprising the steps of:

varying the PWM compressor between on- and off-cycles to provide a percent duty cycle thereof;

synchronizing opening and closing of an isolation valve, respectively with said on- and off-cycles of said PWM compressor, to prohibit migration of liquid refrigerant into the evaporator during said off-cycle.

2. The method of claim 1, further comprising the step of prohibiting reverse migration of said liquid refrigerant into the condenser during the off-cycle.

3. The method of claim 2, wherein a check valve is provided for enabling said step of prohibiting reverse migration.

4. The method of claim 1, further comprising the step of prohibiting reverse migration of vapor refrigerant through the PWM compressor during the off-cycle.

5. The method of claim 4, wherein a check valve is provided for enabling said step of prohibiting reverse migration.

6. A system, comprising:

an evaporator;

a pulse-width modulated (PWM) variable capacity compressor coupled in fluid communication with said evaporator and including a first check valve located at an outlet thereof for prohibiting reverse migration of vapor refrigerant therethrough;

a condenser coupled in fluid communication with said compressor and said evaporator;

an expansion valve disposed intermediate said condenser and said evaporator; and an isolation valve disposed intermediate said condenser and said expansion valve, said isolation valve being in electrical communication with said PWM compressor and operable to respectively synchronize opening and closing of said isolation valve with on- and off-cycles of said PWM compressor, wherein said isolation valve prohibits off-cycle migration of liquid refrigerant.

7. The refrigeration system of claim 6, further comprising a second check valve located at an outlet of said condenser and operable to prohibit reverse migration of said liquid refrigerant into said condenser during an off-cycle of said PWM compressor.

8. The refrigeration system of claim 6, further comprising a liquid refrigerant receiver in fluid communication with and disposed intermediate said condenser and said isolation valve.

9. The refrigeration system of claim 6, further comprising a controller in communication with said PWM compressor for varying a capacity thereof.

10. The refrigeration system of claim 9, further comprising a temperature sensor and a pressure sensor providing operating parameter data to said controller, wherein said controller determines a percent duty cycle of said PWM compressor based on said operating parameter data.

11. A refrigeration system, comprising:

an evaporator;

a pulse-width modulated (PWM) variable capacity compressor coupled in fluid communication with said evaporator;

a condenser coupled in fluid communication with said PWM compressor and said evaporator;

an expansion valve disposed intermediate said condenser and said evaporator;

an isolation valve disposed intermediate said condenser and said expansion valve, and in fluid communication with said PWM compressor; and a controller controlling said isolation valve to respectively synchronize opening and closing of said isolation valve with on- and off-cycles of said PWM compressor, wherein said isolation valve prohibits migration of liquid refrigerant to said evaporator during said off-cycle.

12. The refrigeration system of claim 11, further comprising:

a first check valve in fluid communication with and disposed intermediate said condenser and said PWM compressor, said first check valve operable to prohibit reverse migration of vapor refrigerant through said PWM compressor during said off-cycle of said PWM compressor; and a second check valve in fluid communication with and disposed intermediate said condenser and said isolation valve, said second check valve operable to prohibit reverse migration of liquid refrigerant through said condenser during said off-cycle of said PWM compressor.

13. The refrigeration system of claim 11, further comprising a liquid refrigerant receiver in fluid communication with and disposed intermediate said condenser and said isolation valve.

14. The refrigeration system of claim 11, wherein said controller is in munication with said PWM compressor to vary a capacity thereof.

15. The refrigeration system of claim 14, further comprising a temperature sensor and a pressure sensor providing operating parameter data to said controller, wherein said controller determines a percent duty cycle of said PWM compressor based on said operating parameter data.

* * * * *

UNITED STATES PATENT AND TRADEMARK OFFICE

CERTIFICATE OF CORRECTION

PATENT NO. : 6,672,090 B1
DATED : January 6, 2004
INVENTOR(S) : John Joseph Healy et al.

It is certified that error appears in the above-identified patent and that said Letters Patent is hereby corrected as shown below:

Title page,
Item [75], Inventors, "Man Wai Wu, Hong Kong" should be -- Man Wai Wu, T.K.O (HK) --.
Item [57], ABSTRACT,
Line 14, after "during" insert -- the --.

Column 3,
Line 18, "sensor sensing 30" should be -- sensor 30 sensing --.

Column 7,
Line 6, "munication" should be -- communication --.

Signed and Sealed this

Twentieth Day of April, 2004

JON W. DUDAS
*Acting Director of the United States Patent and Trademark Office*